US008684336B1

(12) United States Patent
Akerman

(10) Patent No.: US 8,684,336 B1
(45) Date of Patent: Apr. 1, 2014

(54) TOP DRIVE AND CROWN APPARATUS FOR DRILLING DERRICK

(76) Inventor: Steve Akerman, Purcell, OK (US)

( * ) Notice: Subject to any disclaimer, the term of this patent is extended or adjusted under 35 U.S.C. 154(b) by 323 days.

(21) Appl. No.: 13/374,790

(22) Filed: Jan. 14, 2012

Related U.S. Application Data

(60) Provisional application No. 61/461,920, filed on Jan. 25, 2011.

(51) Int. Cl.
*B66D 1/36* (2006.01)

(52) U.S. Cl.
USPC ..... 254/337; 254/338; 254/394; 254/400

(58) Field of Classification Search
USPC ..... 254/336–338, 393–400
See application file for complete search history.

(56) References Cited

U.S. PATENT DOCUMENTS

| | | | | | |
|---|---|---|---|---|---|
| 2,734,718 | A | * | 2/1956 | Minor | 254/399 |
| 2,954,131 | A | * | 9/1960 | Wilkinson | 414/22.51 |
| 3,681,928 | A | * | 8/1972 | Vincken et al. | 405/196 |
| 3,936,034 | A | * | 2/1976 | Larralde | 254/399 |
| 3,940,112 | A | * | 2/1976 | Lea | 254/399 |
| 4,390,162 | A | * | 6/1983 | Woolslayer | 254/398 |
| 4,423,994 | A | | 1/1984 | Schefers | |
| 4,478,291 | A | | 10/1984 | Futros | |
| 4,576,517 | A | * | 3/1986 | McCann et al. | 405/195.1 |
| 4,585,213 | A | | 4/1986 | Slagle, Jr. | |
| 4,590,720 | A | | 5/1986 | Reed | |
| 4,753,300 | A | | 6/1988 | Shaw | |
| 4,796,863 | A | | 1/1989 | Reed | |
| 4,842,250 | A | * | 6/1989 | Willis et al. | 254/337 |
| 4,932,175 | A | | 6/1990 | Donnally | |
| 4,969,776 | A | | 11/1990 | Bunce | |
| 5,161,639 | A | | 11/1992 | Ice | |
| 5,450,695 | A | | 9/1995 | Desai | |
| 5,697,457 | A | | 12/1997 | Back | |
| 6,112,834 | A | | 9/2000 | Barrett | |
| 6,336,622 | B1 | | 1/2002 | Eilertsen | |
| 6,412,576 | B1 | | 7/2002 | Meiners | |
| 6,913,096 | B1 | | 7/2005 | Nielsen | |
| 7,178,788 | B1 | * | 2/2007 | Flud et al. | 254/337 |
| 7,290,621 | B2 | | 11/2007 | Orr | |
| 7,461,831 | B2 | | 12/2008 | Mosley | |
| 7,828,086 | B2 | | 11/2010 | Lesko | |
| 2009/0272540 | A1 | | 11/2009 | Rodgers | |

* cited by examiner

*Primary Examiner* — Emmanuel M Marcelo
(74) *Attorney, Agent, or Firm* — Randal D. Homburg

(57) ABSTRACT

An improved crown pulley assembly attached to an upper end of a vertical drilling rig derrick mast used in conjunction with an improved top drive assembly which is used within the drilling rig derrick for the drilling of a well, the improved crown pulley assembly having a crown frame supporting a plurality of pulleys with the top drive providing two sets of paired top drive pulleys, the pulleys suspending a single drive cable through the plurality of pulleys with an anchor end of the single drive cable affixed below the derrick and the winch end of the cable attached to a winch to raise and lower the improved top drive assembly within the drilling rig derrick.

4 Claims, 6 Drawing Sheets

TOP DRIVE AND CROWN APPARATUS FOR DRILLING DERRICK

CROSS REFERENCE TO RELATED APPLICATIONS

Applicant claims the benefit of Provisional Patent Application No. 61/461,920, filed on Jan. 25, 2011, filed by the same inventor.

I. BACKGROUND OF THE INVENTION

1. Field of Invention

An improved crown pulley assembly attached to an upper end of a vertical drilling rig derrick mast used in conjunction with an improved top drive assembly which is used within the drilling rig derrick for the drilling of a well, the improved crown pulley assembly having a crown frame supporting a plurality of pulleys with the top drive providing two sets of paired top drive pulleys, the pulleys suspending a single drive cable through the plurality of pulleys with an anchor end of the single drive cable affixed below the derrick and the winch end of the cable attached to a winch to raise and lower the improved top drive assembly within the drilling rig derrick.

2. Description of Prior Art

A preliminary review of prior art patents was conducted by the applicant which reveal prior art patents in a similar field or having similar use. However, the prior art inventions do not disclose the same or similar elements as the present improved derrick and associated apparatus, nor do they present the material components in a manner contemplated or anticipated in the prior art.

In U.S. Patent Application No. 2009/0272540 to Rodgers, a mobile hydraulic workover rig is disclosed, which includes a rig having a derrick elevated on a base structure comprising containers for equipment used in association with the drilling or workover activity, a work platform including pipe rack sections for storing pipe, with the derrick being open sided with a power cylinder at an upper end for lifting and lowering pipe section away from and into each well, and hydraulic drive cylinders for advancing the rig between wells without telescoping or pivoting the derrick into a travel position, all of the hydraulic components being operated from a central control panel on the work platform. Drilling is performed by an overhead drilling apparatus.

Telescoping derricks on workover rigs are disclosed in U.S. Pat. No. 7,461,831 to Mosley, U.S. Pat. No. 5,450,695 to Desai, U.S. Pat. No. 4,932,175 to Donnally, U.S. Pat. No. 4,590,720 to Reed, and in U.S. Pat. No. 4,969,776 to Bunce. More specifically, Bunce discloses an offshore rig with has extendable caissons with a topside platform, the caissons extending to the bottom of the sea floor, providing a stable working platform. Reed has a plurality of element which telescope one into another so that the derrick can be raised from a short collapsed position into an extended position by the use of four cables, one in each corner of the derrick. Donnally is a telescoping derrick that is light for easy transport and uses structure to enable the mast to be raised from a collapsed horizontal position to a vertical position by hydraulic cylinders, the mast in an retracted position and later the being telescopically raised to full height by a cable means. Mosley is relatively similar to Donnally and also the Rodgers assembly. A very established collapsible derrick tower, using a cable hoist, is disclosed in U.S. Pat. No. 1,299,261 to Taylor.

In U.S. Pat. No. 5,161,639 to Ice, a telescoping rig is disclosed having a safety line attached to the crown which is used to secure a worker within a harness while climbing up the derrick tower. This harness device includes a counterweight within a telescoping tube. This derrick, which is not indicated on a portable rig also appears to have two lower support fins although no function is noted for these lower fins.

Other patents indicate features in prior art which are referenced within in the present crown and top drive apparatus, including U.S. Pat. No. 5,697,457 to Back, which provides a drilling derrick or mast transported on a trailer of a vehicle, which is raised into a vertical position using a pivotal means and a hydraulic ram to elevate the derrick or mast from a horizontal transport position tot a vertical drilling position. In U.S. Pat. No. 4,757,592 to Reed, a method is disclosed which provides a jacking crane erecting four telescoping hydraulically powered legs used to erect a "two spaced parallel column drilling derrick." This is built upon a mud sled platform which provides a secure stable platform upon which to build the drilling derrick.

A telescoping drilling rig is indicated in U.S. Pat. No. 4,932,175 to Donnally which involves a substructure pivotally connecting a lower mast section which is raised and lowered between a horizontal position and a vertical position by a power means (cable), FIG. 5, and an upper mast section being in sliding engagement with the lower mast section, FIGS. 6-7, and a guide assembly for connection between the upper and lower mast sections with foot for securing the upper mast section for telescoping movement within the guide assembly as indicated in FIGS. 2 and 4.

Use of a top drive drilling component on a vertical drilling rig is demonstrated in several drilling rig patents, including U.S. Pat. No. 7,828,086 to Lesko, U.S. Pat. No. 7,290,621 to Orr, U.S. Pat. No. 6,913,096 to Nielsen, U.S. Pat. No. 6,412,576 to Meiners U.S. Pat. No. 6,336,622 to Eilertsen U.S. Pat. No. 6,112,834 to Barrett and U.S. Pat. No. 4,478,291 to Futros, with these top drive mechanisms developed for practical use in the oil fields in the 1980's, even though conceived as early as the 1920's, to overcome the limitations of rotary table drilling systems. These top drive systems provided a means of drilling an entire stand of drill pipe, or multiple single strands of pipe connected together, where the rotary table drilling only provided for the drilling of a single pipe strand at one time. over time, these top drive assemblies have also provided the ability to deliver drilling mud and chemicals to the drilling stem. These top drive assemblies have had difficulty with handling the connection and disconnection of drill pipe, but the moving and handling of stands of drill pipe. Another problem with top drive assemblies is that they do not efficiently provide stability against great rotational force torques sometimes applied to them while being used with a hydraulic drilling system, the higher torque being used for deeper wills or for directional horizontal drilling. The top drive apparatus is of several prior art patents may be employed in the present invention. Futros discloses a top drive connected to a chain which uses a pulley system to divert the pressure of lifting the top drive and applying drilling pressure to the base of a drilling derrick instead of the drilling pressure being forced against the top of the derrick. Eilertson indicated the use of a lifting device having rack segments which are moved up and down by using driving gear and shifting the load handles by the lifting tackle to the bottom of the derrick.

A double derrick drilling rig is disclosed in the Meiners patent which provides a top drive with two opposing guide trolleys on the ends of opposing counter-torque arms which are directed against some object on each of the two derrick towers, and presumably some type of tract, since the guide trolleys appear to have some type of four wheeled rolling means on each guide trolley. More directly, a top drive integrating within a drilling rig is the subject of the Orr patent, wherein the derrick is provided with a track system on the inner surfaces of the derrick, which may be a telescoping derrick assembly, with the top drive having a plurality of pads engaging a pair of structural guide rails comprised of a pair of rectangular tubes which extend the length of the mast of the derrick assembly. The top drive is suspended from the crown by a wire being guided over pulleys to raise and lower the top drive along the length of the mast or derrick. The top drive is locked in position along the mast by lock pins during maintenance or transport. The pads on the top drive are part of a disclosed vertical "guidance and torque reaction mechanism".

Most recently, Lesko discloses a guide rail system for a telescoping mast on a drilling rig which disclose a rail system on the inner portion of the telescoping mast having parallel guide tracks of tubular steel welded to the derrick, with the lower and upper mast sections each having these guide tracks, FIG. 8. The top drive provides an upper and lower set of track wheels facing opposing outer directions from the top drive, each wheel defining a hub, an inner ridge, a middle ridge and an outer ridge, the ridges positioned on the outer margins of the guide tracks, FIG. 9. This three ridge track wheels allow for a transition between the guide tracks of the lower mast when transferring position to the upper mast. These track and top drive systems, as well as the derrick guide track and top drive lateral guide track assemblies disclosed in contemporaneously file patent applications by the same inventor are contemplated as being used in the present improved crown pulley assembly and top drive assembly.

Crown assemblies are secured to the top of a drilling derrick and used with a cable or wire to raise and lower drilling tools, accessories and completion tools during the drilling and completion of a well. This can be accomplished by a single wire and a relatively few number of pulleys suspended within a crown frame at the top of the derrick, the pulleys being positioned to direct the cable over the crown pulley assembly with as little resistance as possible. In the Lesko '086 patent, supra, which focuses more attention to the top drive assembly along the tracks of a telescoping derrick assembly, the drawing figures clearly show a series of three pulleys on within the crown which suspend the top drive and by implied use of a cable, raise and lower the top drive. In one of several patents issued to Reed, including U.S. Pat. No. 4,796,863, multiple pulleys are presented within the crown block attached to a number of pulleys on the cat head or drilling tool which is moveable within the derrick for moveable location of the tool in relation to the ground or drilling platform. In Mosely '831, supra, a series of pulleys are attached to the top of the drilling derrick which are used to raise and lower a top drive or other apparatus within the derrick assembly. None of the crown assemblies disclose the crown pulley assembly as disclosed in the present improved crown pulley assembly in frame construction, pulley orientation or functional relationship with the top drive assembly.

In U.S. Pat. No. 4,423,994 to Schefers, the advantage of a block and tackle pulley system are demonstrated by the addition of pairs of block and tackle systems in conducting drilling operations, which included support of the drilling string and movement of the drilling string. However, the main focus of the provision of multiple block and tackle devices on a single well were to allow multiple operations independent of one another but occurring simultaneously, so that repeated rigging and unrigging of the block and tackle during drilling operations is avoided. This patent further discloses the use of the block and tackle with the cable being anchored and one end and would within a winch at the other end.

II. SUMMARY OF THE INVENTION

Top drive assemblies are utilized in the oil fields to provide a means of drilling an entire stand of drill pipe or multiple single strands of pipe connected together and are used in place of rotary table drilling devices which allow for the drilling of a single strand of pipe at one time. Top drive assemblies have provided the rotational forces to drive the drilling stem for drilling operations and also provided for the introduction of drilling muds and fluids within the same apparatus.

The present improved top drive assembly focuses on the track and movement aspects of the top drive assembly, but does not address any improvement to the top drive assembly itself with regard to operation of the top drive. The top drive, as used in this improved assembly may be an electric or hydraulic top drive, with the top drive having a body that for purposes of this submission includes the body defining a motor, and possibly a transmission, that is suspended from the derrick or mast of the rig with a great amount of horsepower that turn a shaft to which the drill string is screwed, replacing the traditional Kelly or rotary table, the top drive lessening the manual labor involved in drilling and significantly reducing safety risks to rig workers. Terms typically used to define the other significant components of the top drive beyond the motor would be a short section of pipe called a quill which is connected to the drill string and engaging the motor, a traveling block which suspends the motor from a hook which allows the top drive to be raised and lowered quickly and accurately, and a means to deliver and withdraw drilling fluids and liquids to the bore hole. these features of the top drive will simply be referenced as the top drive body.

The known advantages of the top drive assembly over alternative drilling engines and means provide an improvement over other drilling rigs including the ability to drill multiple joint stands instead of a single pipe at a time, decrease the incident of stuck pipe and pipe damage, providing a nearly constant rotation of the drilling stand and downhole string, provide a more quick engaging and disengaging pumps or the rotary while removing and restringing pipe, and provide the ability to drill deeper vertical well, to perform directional and horizontal drilling which require a greater torque force than a rotary table rig can deliver, pipe handling features used with top drives using hydraulic arms to move drill pipe and drill collars to and from the pipe racks without worker involvement, the ability to skew into the drill string at any location in the derrick, preferably within the top drive itself, to circulate drilling fluids, continuous rotation when removing the drill string from or tripping back into directional or horizontal wells, and a substantive reduction in drilling costs by reducing the chance of sticking the drill string or losing expensive bottom hole drilling assemblies. There are numerous other advantages associated with the top drive assembly know in the field of art.

Most top drives used today employ the use of one or more cables to raise and lower the top drive, the cable being led over a crown pulley assembly at the top of the derrick tower within which the top drive is used. This includes single mast derricks as well as telescoping derricks seen in the prior art disclosed above. See, Meiners '622, Orr '096 and Lesko '621, supra. Several top drive assemblies are demonstrated in the noted prior art patents of Reed '863, Lesko '086 and Mosely '831, but they do not include a crown pulley assembly which positions the multiple pulleys of the crown assembly in the same manner or with the same number of pulleys over which the single strand of drive cable is directed, nor do they integrate with the pulleys of the top drive assembly in the same manner as the present improved crown assembly and improved top drive assembly.

The basic physics which comprise the improvements to the disclosed within the present improved crown pulley assembly and improved top drive assembly arise from the concept of a block and tackle pulley system. It is known in the art that the use of the block and tackle have been used for a very long time to provide a more efficient means of lifting an object using a less amount of force than required to simply lift the object. This is the basic lesson disclosed in Schefers '994, but the physics involved in the block and tackle provide the improvement to the present improved crown pulley assembly and improved top drive assembly. The present crown pulley assembly provides a series of seven pulleys which are rotatably affixed in position to direct each independent pulley within the crown pulley frame in a certain direction which further directs the single strand cable to a location to interact with the four pulleys of the improved top drive assembly to raise and lower the top drive assembly, the single strand cable having an anchor end and a winch end.

In providing the seven independent pulleys within the crown pulley assembly which rotate with a little friction as can possibly be provided, and the four independent pulleys within the top drive assembly working together to direct the single strand cable throughout the various pulleys, again with as little frictions can be possibly provided and being reduced by the direction and orientation of the axis of each pulley, less force is required to lift the top drive assembly by the single strand cable and less force is also required upon the winch used in conjunction with the single strand cable.

III. DESCRIPTION OF THE DRAWINGS

The following drawings are submitted with this utility patent application.

FIG. 6 is a well side view of the improved top drive assembly and improved derrick crown assembly indicating their vertical relationship upon the drilling rig derrick.

IV. DESCRIPTION OF THE PREFERRED EMBODIMENT

Figure 1:
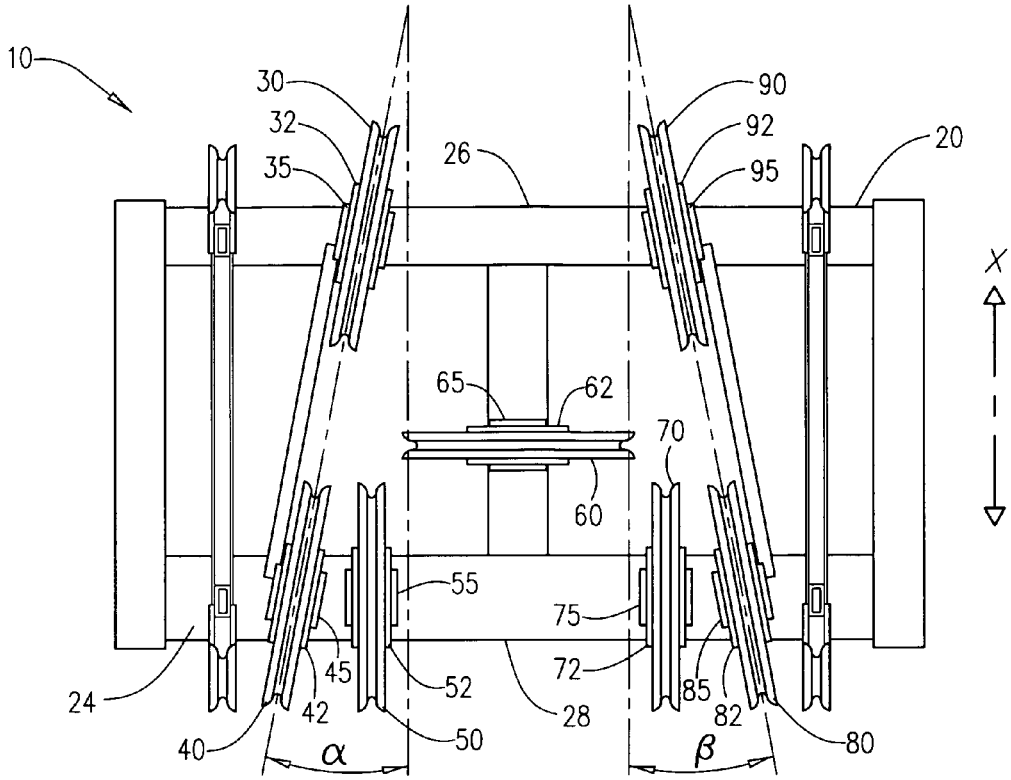
FIG. 1 is a top view of the improved derrick crown assembly.
Figure 2:
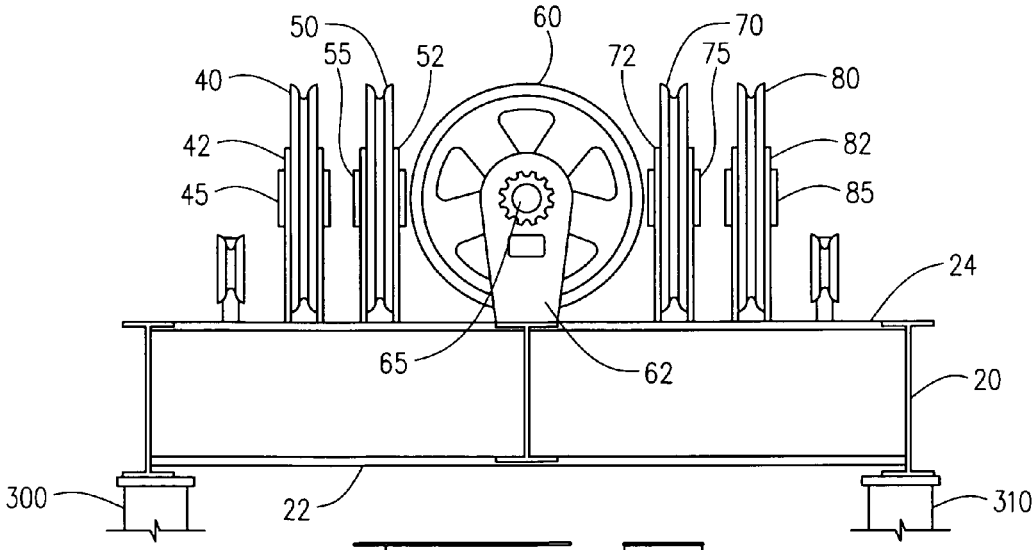
FIG. 2 is a well side view of the improved derrick crown assembly.
Figure 3:
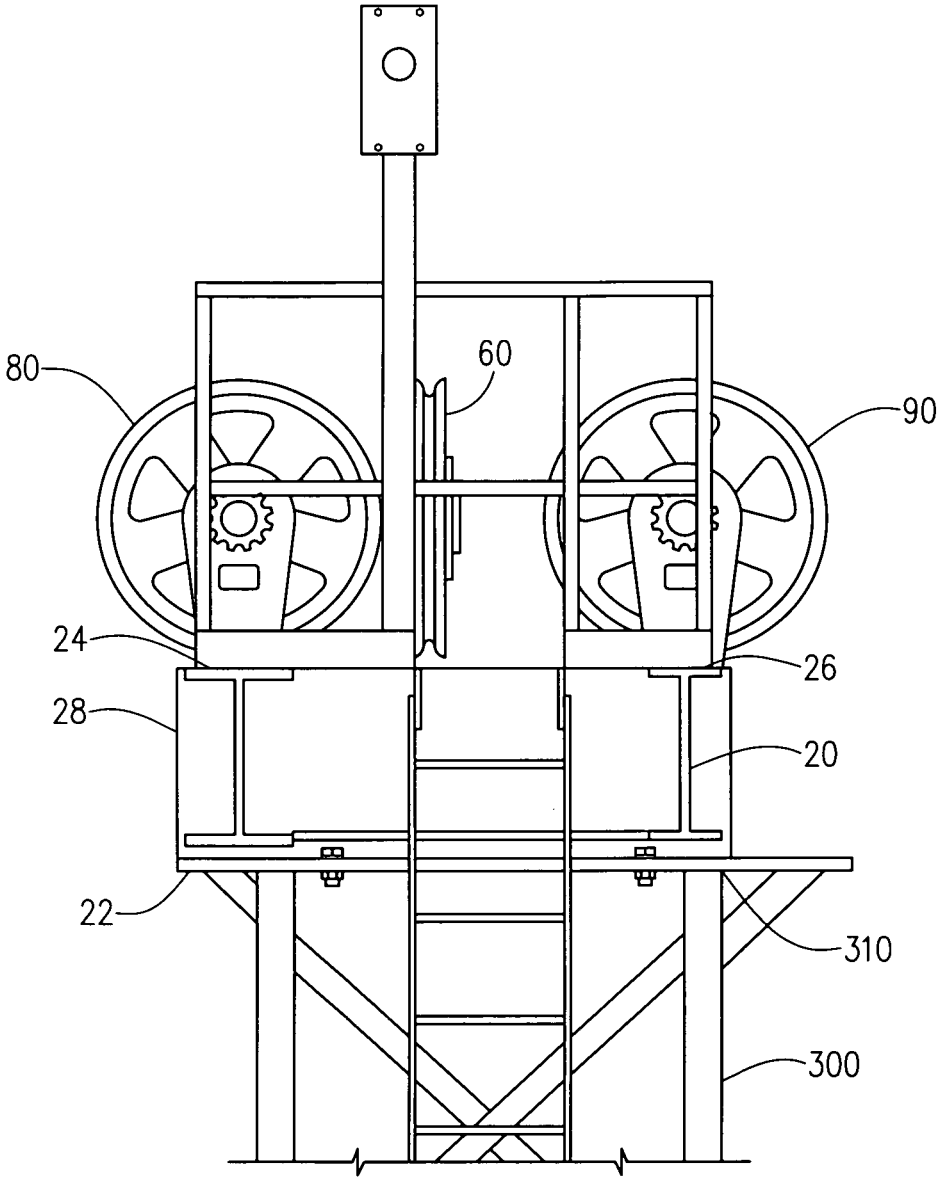
FIG. 3 is a left side view of the improved derrick crown assembly attached to the upper end of the drilling derrick.

An improved crown pulley assembly 10 attached to an upper end 310 of a drilling rig derrick 300, the drilling rig derrick 300 having a lower end 320 secured to a derrick support base 350, the drilling rig derrick 300 employing an improved top drive assembly 100, the improved crown assembly 10, shown in FIGS. 1-3, 6 and 7, defining a lower frame member 20 having a lower portion 22 attached to the upper end 310 of the derrick 300 and defining a rig side 26 and a well side 28, and an upper portion 24 rotatably suspending an angled first rig side pulley 30, an angled second well side pulley 40, a perpendicular third well side pulley 50, a central fourth transitional pulley 60, a perpendicular fifth well side pulley 70, an angled sixth well side pulley 80 and an angled seventh rig side pulley 90, with the first rig side pulley 30 and second well side pulley 40 being in alignment, the third well side pulley 50 and the fifth well side pulley 70 being parallel and sharing a common axis, the fourth transitional pulley 60 being perpendicular to the third and fifth well side pulleys 50, 70 and suspended above the lower frame member 20 between the well side pulleys 40, 50, 70, 80 and the rig side pulleys 30, 90, and the sixth well side pulley 80 and seventh rig side pulley 90 being in alignment.

Figure 4:
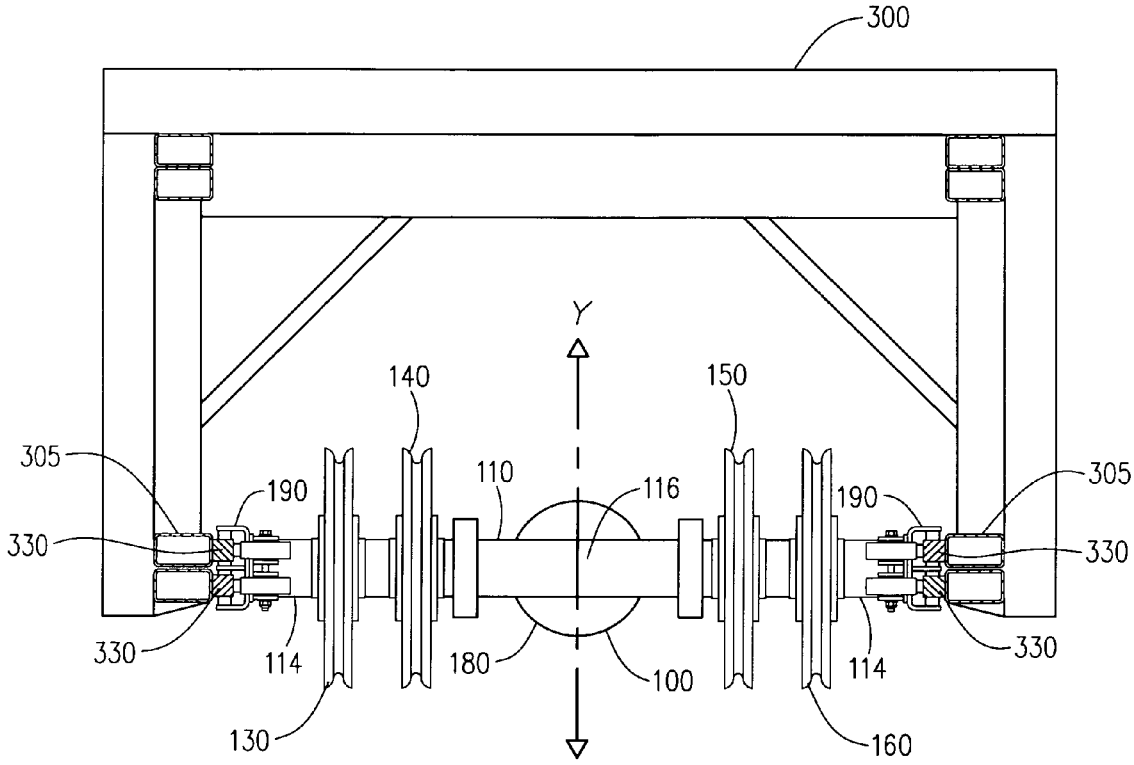
FIG. 4 is a top view of the improved top drive assembly associated with the improved derrick crown assembly as located within the drilling derrick.
Figure 5:
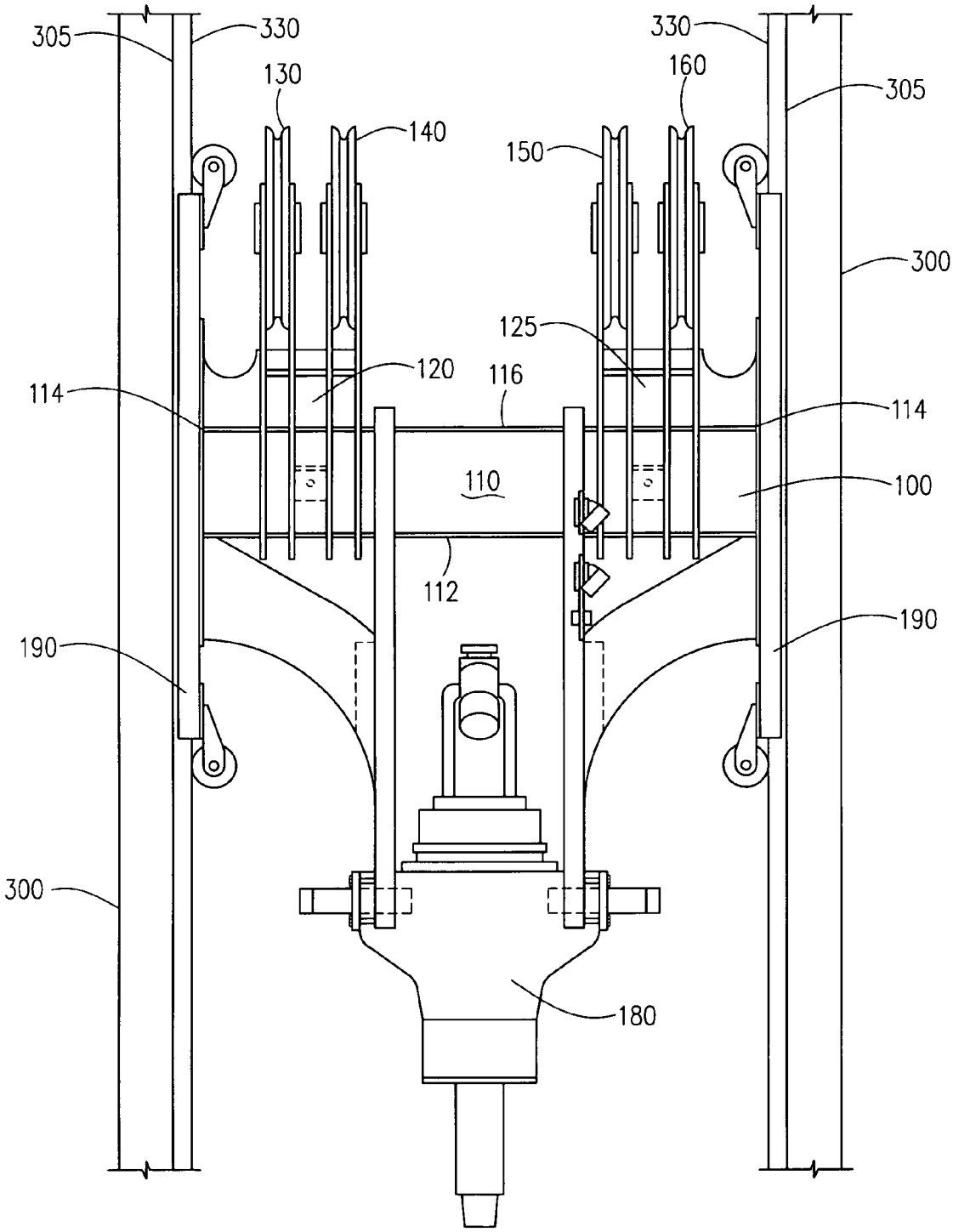
FIG. 5 is a rear and well side view of the improved top drive assembly as located within the drilling derrick.
Figure 5:
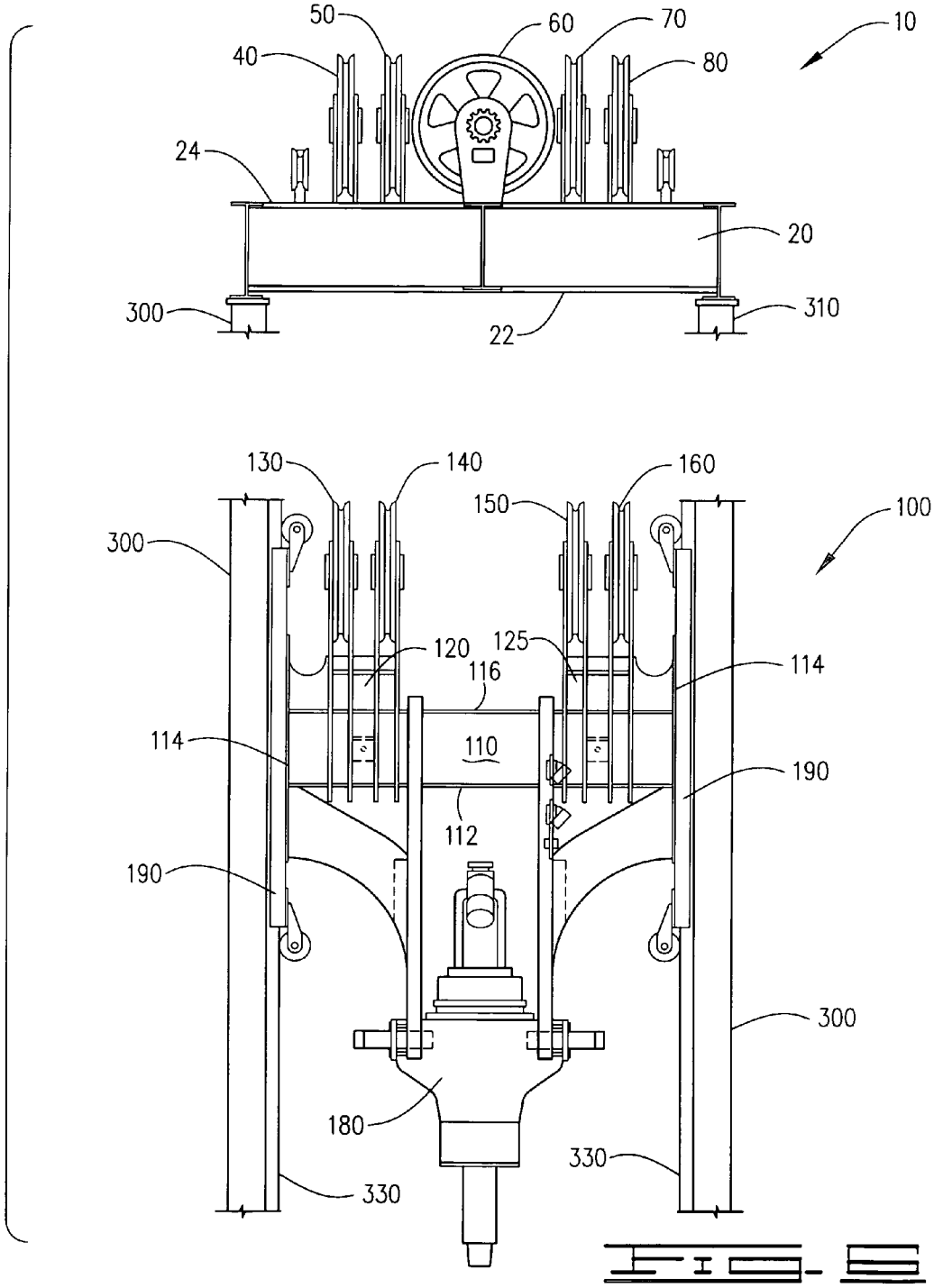

The improved top drive assembly 100, as shown in FIGS. 4-6, is slidably engaged with the drilling rig derrick, the improved top drive assembly 100 comprising an upper top drive support member 110 defining a lower portion 112 suspending a top drive member 180, two lateral side portions 114 each supporting vertical guide tracks 190 which slidably engage guide rails 330 welded upon inner facing surfaces 305 of the drilling rig derrick 300 in the manner shown as a sectional view of a telescoping version of the drilling rig derrick in FIG. 4, and an upper portion 116 extending a left side pulley support member 120 and a right side pulley support member 125, each pulley support member 120, 125 rotatably suspending a set of paired parallel top drive pulleys 130, 140 and 150, 160 which are equidistant from each lateral side portions 114, each pulley parallel the others and sharing a common axis Y, each pulley further individually designated and referenced in FIGS. 4-6 as an outer left pulley 130 and an inner left pulley 140 extending upward from the left side support member 120, and an inner right pulley 150 and an outer right pulley 160 extending upward from the right side support member 125.

Figure 7:
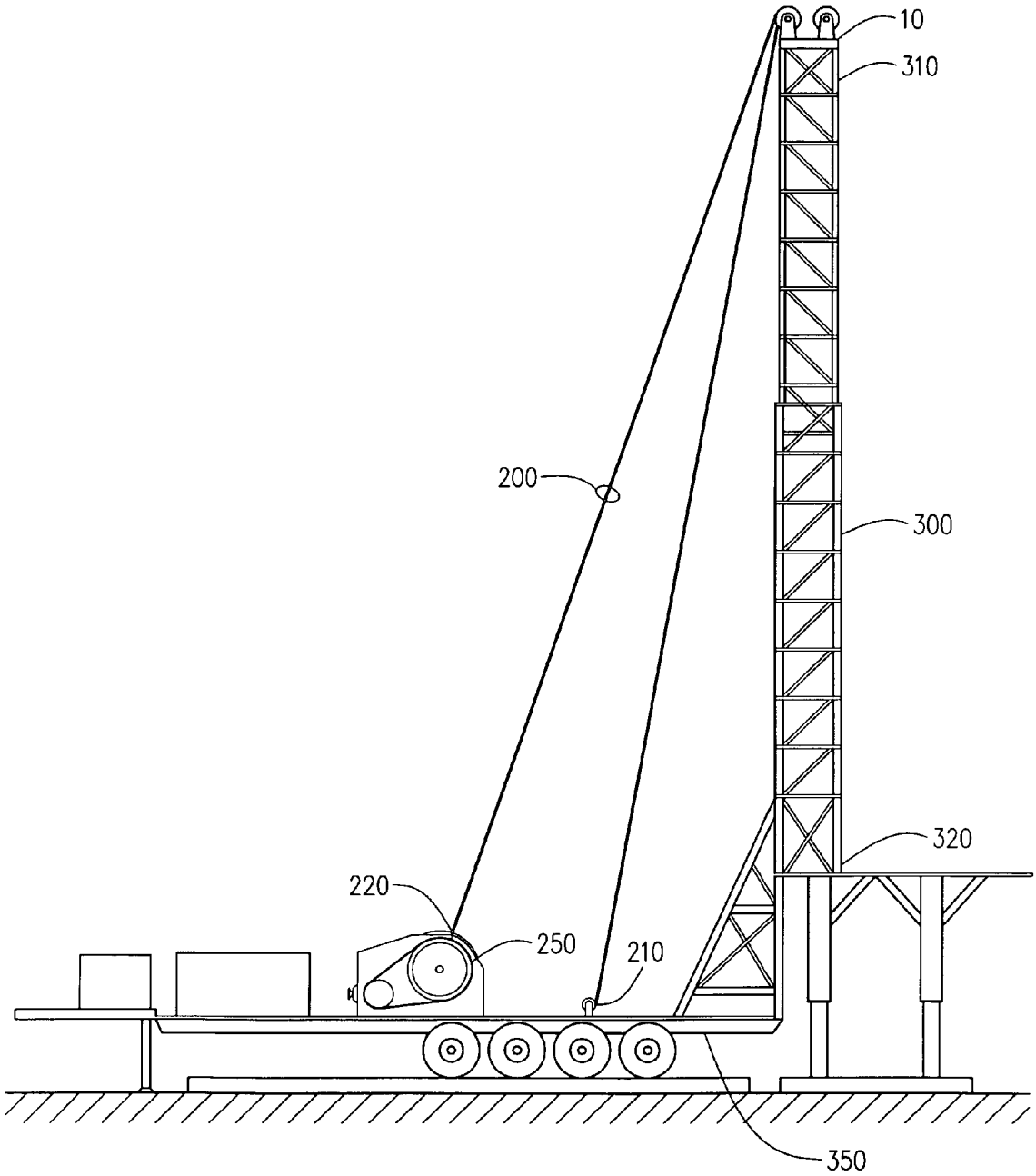
FIG. 7 is a left side view of the drilling rig derrick, the derrick support base and the improved top crown assembly.

A single strand cable 200 is utilized in the improved crown pulley assembly 10 and the improved top drive assembly 100, the single strand cable 200 defining an anchor end 210 attached to the derrick support base 350 and a winch end 220 which is wound about a cable winch 250 attached to the derrick support base 350, FIG. 7, with the single strand cable 200 routed in relationship to FIGS. 1, 6 and 7, from the anchor end 210 upward from the rig side 26 of the crown pulley assembly 10 over the first rig side pulley 30, over to the second well side pulley 40, downward to the outer left pulley 130 of the top drive assembly 100, upward to the third well side pulley 50, downward to the inner left pulley 140 of the top drive assembly 100, upward to the fourth transitional pulley 60, down to the inner right pulley 150 of the top drive assembly 100, upward to the fifth well side pulley 70, downward to the outer right pulley 160 of the top drive assembly 100, upward to the sixth well side pulley 80, over to the seventh rig side pulley 90 and further directed downward to the cable winch 250 attached to the derrick support base 350, wherein the single strand cable 200 is wound and unwound to raise and lower the top drive assembly 100 within the drilling rig derrick 300. It is contemplated that the single strand cable 200 could be wound around the pulleys in reverse, also.

The improved crown pulley assembly 10 further comprises each pulley 30, 40, 50, 60, 70, 80, 90 being attached to the upper portion 24 of the lower frame member 20 by an independent upward extending pulley support base 32, 42, 52, 62, 72, 82, 92 retaining an axle 35, 45, 55, 65, 75, 85, 95 upon which the respective pulley is rotatably suspended. This may involve an optional bearing, not shown, between the pulley support base and the respective axle or between a stationary axle and each pulley. An axis X is defined within the crown pulley assembly 10 which is shown as a line which is directed from the well side 28 to the rig side 26 of the crown pulley assembly 10. This axis, as shown in FIGS. 1 and 6, is aligned with the rotational axis of the third and fifth well side pulleys 50, 70. The same axis is aligned with the rotational axis the four pulleys 130, 140, 150, 160 of the top drive assembly. The first rig side pulley 30 and the second well side pulley 40 are offset from the axis X at an angle α from the rig side 26 to the well side 28 left of 20-30 degrees, while the sixth well side pulley 80 and seventh rig side pulley 90 are offset from the axis X at an angle β from the rig side 26 to the well side 28 right of 20-30 degrees, as indicated in FIG. 1. While it is preferred that the upward extending pulley support bases 32, 42, 52, 62, 72, 82, 92 are firmly attached to the lower frame member 20, it is contemplated within the scope of the improved crown pulley assembly 10 that some or all of the pulley support bases could be pivotally attached to the lower frame member, either fully or partially. It is not contemplated within the scope of the improved top drive assembly 100 that the pulleys be anything other than affixed in the position shown in FIGS. 4-6.

Utilizing the seven pulleys 30, 40, 50, 60, 70, 80, 90 of the improved top drive assembly 10 and the four pulleys 130, 140, 150, 160 of the improved top drive 100 as indicated, the mechanical advantage of the multiple pulleys and single strand cable 200, setting aside the friction of the single strand cable through the series of pulleys, decreases the force required to raise and lower the top drive by an ideal ratio of approximately 8:1, since there are practically four block and tackle mechanisms involved in the series of pulleys and the single strand cable as disclosed. This presents a significant reduction in forces required to raise and lower the top drive assembly over prior art. Further improvement is demonstrated in the manner the single strand cable is directed through the series of pulleys of the improved crown pulley assembly and the improved top drive assembly. [Mechanical Advantage=Force of the Load/Input, hauling force required to move the load, or MA=Fb/Fa; each block and tackle reducing the force by a 2:1 ratio×4 sets of blocks and tackle=8:1]

While the improved crown pulley assembly 10 and improved top drive assembly 100 have been particularly shown and described with reference to a preferred embodiment thereof, it will be understood by those skilled in the art that changes in form and detail may be made therein without departing from the spirit and scope of the improvements to the crown pulley assembly 10 and the top drive assembly 100.

What is claimed is:

1. An improved crown pulley assembly and an improved top drive assembly, said improved crown pulley assembly attached to an upper end of a drilling rig derrick, said drilling rig derrick having a lower end secured to a derrick support base, said drilling rig derrick vertically suspending said improved top drive assembly, said improved drown pulley assembly and improved top drive assembly comprising:

said improved crown assembly providing a lower frame member defining a well side and a rig side, a lower portion attached to said upper end of said derrick, and an upper portion rotatably suspending an angled first rig side pulley, an angled second well side pulley, a perpendicular third well side pulley, a central fourth transitional pulley, a perpendicular fifth well side pulley, an angled sixth well side pulley and an angled seventh rig side pulley, with said first rig side pulley and second well side pulley being in alignment, said third well side pulley and said fifth well side pulley being parallel and sharing a common axis, said fourth transitional pulley being perpendicular to said third and fifth well side pulleys and suspended above said lower frame member between said well side pulleys and said rig side pulleys, and said sixth well side pulley and seventh rig side pulley being in alignment; and said improved top drive assembly is slidably engaged with said drilling rig derrick, said improved top drive assembly comprising an upper top drive support member defining a lower portion suspending a top drive member, two lateral side portions each supporting vertical guide tracks which slidably engage guide rails welded upon inner facing surfaces of a pair of parallel well side legs defining a channel within said drilling rig derrick, and an upper portion extending a left side pulley support member and a right side pulley support member, each said pulley support member rotatably suspending a set of paired parallel top drive pulleys which are equidistant from each lateral side portions, each pulley parallel with another and sharing a common axis, each pulley further defining an outer left pulley and an inner left pulley extending upward from said left side support member, and an inner right pulley and an outer right pulley extending upward from said right side support member.

2. The improved crown pulley assembly and improved top drive assembly, as disclosed in claim 1, further comprising:

a single strand cable utilized in said improved crown pulley assembly and said improved top drive assembly, said single strand cable defining an anchor end attached to said derrick support base and a winch end wound about a cable winch attached to said derrick support base, said single strand cable being threaded and directed from said anchor end upward from said rig side of said crown pulley assembly over said first rig side pulley, over to said second well side pulley, downward to said outer left pulley of said top drive assembly, upward to said third well side pulley, downward to said inner left pulley of said top drive assembly, upward to said fourth transitional pulley, down to said inner right pulley of said top drive assembly, upward to said fifth well side pulley, downward to said outer right pulley of said top drive assembly, upward to said sixth well side pulley, over to said seventh rig side pulley and further directed downward to said cable winch attached to said derrick support base, wherein said single strand cable is wound and unwound by said cable winch from said derrick support base to raise and lower said top drive assembly within said drilling rig derrick.

3. The improved crown pulley assembly and improved top drive assembly, as disclosed in claim 1, further comprising each said pulley within said improved top crown assembly is independently attached to said upper portion of said lower frame member by an independent upward extending pulley support base upon which said respective pulley is rotatably suspended.

4. The improved crown pulley assembly and improved top drive assembly, as disclosed in claim 1, further comprising an axis defined within said crown pulley assembly directed from said well side to said rig side of said crown pulley assembly, said axis aligning a rotational axis of said third and fifth well side pulleys aligning said rotational axis said four pulleys of said top drive assembly and wherein said first rig side pulley and said second well side pulley are offset from said axis at an angle from said rig side to said well side left of 20-30 degrees, while said sixth well side pulley and seventh rig side pulley are offset from said axis at an angle from said rig side to said well side right of 20-30 degrees.

* * * * *